US007102589B2

(12) United States Patent
Schadler et al.

(10) Patent No.: US 7,102,589 B2
(45) Date of Patent: Sep. 5, 2006

(54) APPARATUS AND METHOD TO INCREASE ISOLATION BETWEEN SEPARATE IN-CHANNEL ANTENNAS SHARING A COMMON APERTURE SPACE

(75) Inventors: John L. Schadler, Raymond, ME (US); Keith L. Pelletier, New Gloucester, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 10/900,371

(22) Filed: Jul. 28, 2004

(65) Prior Publication Data

US 2005/0219143 A1 Oct. 6, 2005

Related U.S. Application Data

(60) Provisional application No. 60/558,113, filed on Apr. 1, 2004.

(51) Int. Cl.
*H01Q 21/00* (2006.01)
*H01Q 9/16* (2006.01)

(52) U.S. Cl. ..... 343/893; 343/983; 343/853; 343/793; 343/810

(58) Field of Classification Search ..... 343/893
See application file for complete search history.

(56) References Cited

U.S. PATENT DOCUMENTS

| | | | | |
|---|---|---|---|---|
| 6,914,579 | B1 * | 7/2005 | Schadler | 343/890 |
| 2004/0189540 | A1 * | 9/2004 | Schadler | 343/890 |
| 2005/0068244 | A1 * | 3/2005 | Downs et al. | 343/797 |
| 2005/0146482 | A1 * | 7/2005 | Schadler | 343/853 |
| 2005/0219143 | A1 * | 10/2005 | Schadler et al. | 343/893 |

* cited by examiner

*Primary Examiner*—Trinh Vo Dinh
(74) *Attorney, Agent, or Firm*—Baker & Hostetler LLP

(57) ABSTRACT

A system for increasing isolation between analog and digital antennas suited for FM IBOC operations is provided, wherein an interleaved combination of dissimilar antennas are arrayed with an offset there between to obtain a desired performance the use of dissimilar antennas and an offset, several additional degrees of freedom are afforded to the broadcaster in obtaining the desired isolation between signals, and also for upgrading an existing analog system to IBOC capability.

24 Claims, 2 Drawing Sheets

APPARATUS AND METHOD TO INCREASE ISOLATION BETWEEN SEPARATE IN-CHANNEL ANTENNAS SHARING A COMMON APERTURE SPACE

This application claims priority to provisional U.S. patent application entitled, "Increasing Isolation Between Separate In-Channel FM Antennas Sharing Common Aperture Space," by John Schadler, filed Apr. 1, 2004, having a Ser. No. 60/558,113, the disclosure of which is hereby incorporated by reference in its entirety.

FIELD OF THE INVENTION

The present invention generally relates to antenna systems. More particularly, the present invention relates to combining within a common aperture space an antenna system with differing physical properties into another antenna system, and obtaining increased isolation between antenna systems by offsetting the systems.

BACKGROUND OF THE INVENTION

FM radio is in wide use in the field of radio broadcast. The term FM includes, for example, any of the Frequency Modulation methodologies used or developed for signal broadcasting in a frequency band assigned by the U.S. Federal Communications Commission (FCC), nominally in the transmission range 88 MHz to 108 MHz, which is near the middle of the Very-High-Frequency (VHF) television broadcast band. These Frequency Modulation technologies include both analog FM and digital FM.

The FCC has adopted a standard for analog-digital FM transmission called the iBiquity IBOC (In-Band-On-Channel) for hybrid analog-digital transmission systems. According to the IBOC standard, FM stations in the United States must be able to simultaneously broadcast analog and digital signals within their current allocated frequency range. One approach for achieving the above simulcast is to use two separate transmission systems (for example, analog-digital) to feed two separate antennas (for example, analog-digital). Since the elevation of the antenna on the tower directly affects the antenna's coverage, it would be desirable to co-locate the radiated analog and digital signals at the same height above the ground to maintain the same coverage.

Also, since the azimuthal pattern of an FM antenna is very dependent on the cross section of the tower structure, it would be desirable to mount both the analog and digital antennas in the same orientation with respect to the tower. When adding digital coverage, concerns are that many towers are already full having no additional aperture space available. Therefore, many FM broadcasters have responded by vertically interleaving the second digital antenna within the aperture of their existing analog antenna.

A technical challenge in the broadcast community is the fact that the analog and digital signals occupy the same band width, but require isolation between the two systems. Current requirements for isolation between the IBOC digital and analog signals is on the order of 35 dB. If the IBOC and analog antennas are in the same aperture, in order to reduce the filtering requirements the highest level of antenna isolation is preferable. Herethereto, conventional approaches to this dilemma have resulted in antenna systems using sophisticated signal conditioning schemes, pattern manipulation orthogonization, and isolation equipment. All of these approaches rely on the use of similar radiators, in conformity to legacy systems and FCC regulations.

However, the FCC has issued a Public Notice DA04-712, dated Mar. 17, 2004, authorizing the use of separate antennas for digital FM transmissions that are within three geographical seconds of the current analog site. The FCC's public notice on the approval of separate antennas to initiate digital FM digital transmissions explicitly enables the broadcaster to use a separate digital antenna on a separate tower—thereby ameliorating the current dilemma of adding a digital antenna to an existing overcrowded analog tower.

However, the use of a separate tower dedicated to digital systems unavoidably incurs significant tower, cabling, and material costs, as well as the resources necessary to maintain twice as many towers as in the analog operation.

Thus, in view of the FCC's public notice, alternate schemes and techniques for providing FM transmission are desirable. Specifically, schemes or techniques that reduce the isolation concerns without requiring a separate tower.

SUMMARY OF THE INVENTION

The foregoing needs are met, to a great extent, by the present invention, wherein in one aspect an apparatus and method is provided that in some embodiments utilize different digital signal radiating elements which are mounted at different positions to the supporting antenna tower than the analog radiating elements. By using different radiating elements for both the analog and the digital signals, and/or slightly offsetting the digital antenna from the analog antenna, the isolation between the analog and the digital systems can be greatly increased. Various combinations using concepts based on the use of dissimilar antenna systems and/or offset locations are described herein.

In accordance with one embodiment of the present invention, an interleaved broadcast antenna structure is provided, comprising a plurality of analog signal transmitting antennas arranged as a substantially collinear first array, a plurality of digital signal transmitting antennas arranged as a substantially collinear second array, wherein the analog signal transmitting antennas and the digital signal transmitting antennas are of a different antenna type, and an axis of the first array and an axis of the second array are parallel and significantly displaced from each other, and feed lines coupled to the antennas of the first and second arrays.

In accordance with another embodiment of the present invention, an interleaved broadcast antenna structure is provided, comprising a plurality of analog signal radiating means for radiating analog electromagnetic energy arranged as a substantially collinear first array, a plurality of digital signal radiating means for radiating digitally coded electromagnetic energy, arranged as a substantially collinear second array, wherein the analog radiating means and the digital radiating means are of a different type, and an axis of the first array and an axis of the second array are parallel and significantly displaced from each other, and feed means for feeding the respective electromagnetic energy to the respective radiating means.

In accordance with yet another embodiment of the present invention, a method for assembling a digital and analog array of antennas is provided, comprising the steps of interleaving collinear array of digital signal transmitting antennas into a collinear array of analog signal transmitting antennas, arranging the arrays of antennas to be parallel and offset from each other, arranging the antennas of the arrays to be approximately ½ wavelength separated from each other, and adjusting the offset between the arrays to increase isolation between the analog signal transmitting antennas and the digital signal transmitting antennas.

In accordance with yet another embodiment of the present invention, a method for transmitting digital and analog radio waves is provided, comprising the steps of interleaving collinear array of digital signal transmitting antennas into a collinear array of analog signal transmitting antennas, arranging the arrays of antennas to be parallel and offset from each other, arranging the antennas of the arrays to be approximately ½ wavelength separated from each other, feeding a digital signal into the digital signal transmitting antennas, feeding an analog signal into the analog signal transmitting antennas, and adjusting the offset between the arrays to increase isolation between the analog signal transmitting antennas and the digital signal transmitting antennas.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
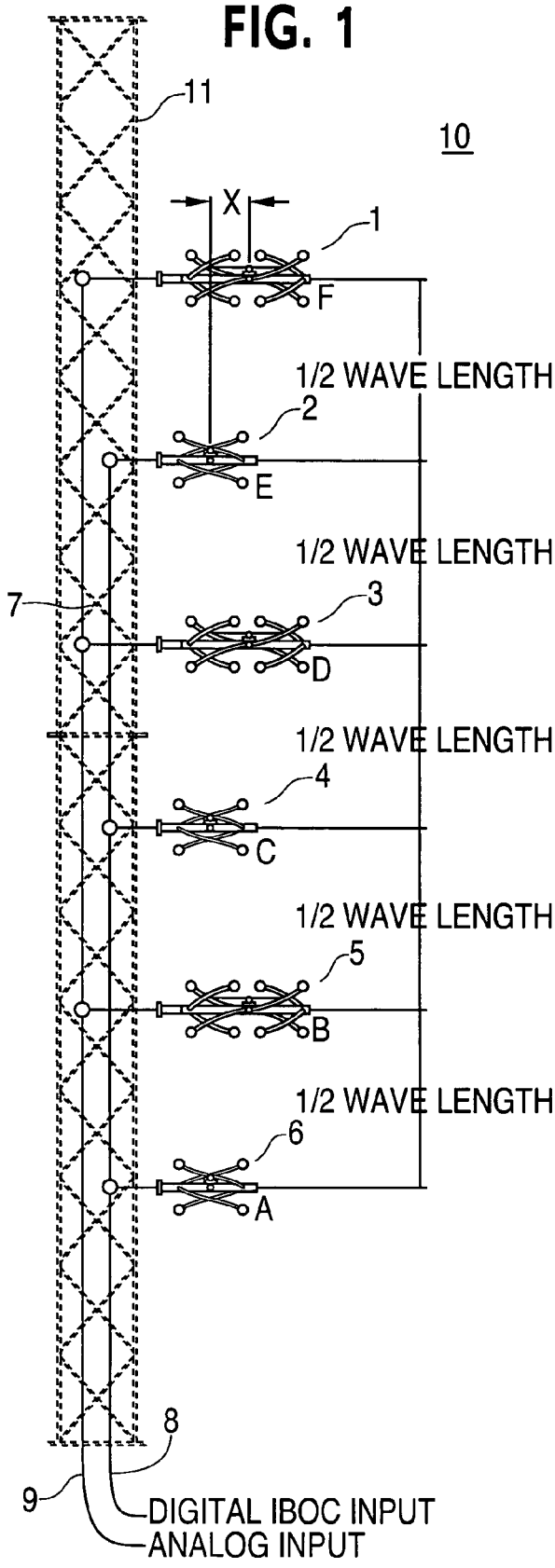
FIG. 1 is an illustration of an antenna tower with an IBOC compliant array interleaved with an analog array according to a preferred embodiment of the invention.

The present invention provides methods and systems to combine, within a common aperture space, an antenna system with differing physical properties into another antenna system, and obtaining increased isolation between antenna systems by offsetting the systems. The invention will now be described with reference to the drawing figures, which like reference numbers refer to like parts throughout.

FIG. 1 illustrates an exemplary antenna system 10 using dissimilar radiators and offsets, according to this invention. The exemplary antenna system 10 of FIG. 1 is shown with three analog-fed antennas, 1, 3, 5 displaced from each other by approximately a full wavelength of the analog operating frequency. The analog-fed antennas 1, 3, 5 are coupled to a feed assembly 7 which is supported by the antenna tower 11. The feed assembly 7 in turn, is coupled to the analog input 9, wherein an analog signal is injected into the feed assembly 7 by a tower-located or remote transmitter (not shown).

Digitally-capable antennas 2, 4, 6 are also interspersed within the analog antennas 1, 3, 5 in full wavelength intervals. The digital-capable antennas 2, 4, 6 are also connected to the feed assembly 7 and are fed by a digital IBOC input 8. The digital IBOC input 8 conveys digital signals by a tower-located or remote transmitter (not shown).

The analog antennas 1, 3, 6 and the digital antennas, 2, 4, 6 are vertically collinear within their respective systems and approximately ½ wavelength separated from each other. The antenna elements of the respective systems are dissimilar and the arrays are horizontally displaced from each other. Specifically, the analog antennas 1, 3, 5 are of a different type than that of the digitally-capable antennas 2, 4, 6. In FIG. 1, the analog antennas 1, 3, 5 are illustrated as right-hand-polarized quadrapole helixes with four curved dipoles, collinear with respect to each other and displaced an arbitrary distance X from a vertical axis piercing the array of digitally-capable antennas 2, 4, and 6. The digitally-capable antennas 2, 4 and 6 are shown in FIG. 1 as a collinear array of left-hand polarized short helixes with two curved dipoles.

The antenna elements of conventional analog-digital or IBOC systems are oppositely polarized between the digital and analog antennas to achieve a high level of isolation, when being co-located in the same aperture window. For systems using similar antenna elements, such as a quadrapole DCR-M system, the opposing polarization can offer anywhere from 20–25 dB or more of isolation between systems. However, to achieve a 30 dB transmitter required isolation, isolators are typically required in these conventional systems. These isolators are an extra cost and maintenance concern to broadcasters.

As illustrated in the exemplary embodiment of FIG. 1, by implementing dissimilar radiators and an offset there between, an FCC compliant level of isolation can be obtained without using isolators. Further, the arbitrary distance X between the systems offers an increased isolation between the antenna systems, as detailed below.

It should be appreciated that while the exemplary embodiment shown in FIG. 1 illustrates circularly polarized helical elements as the principal radiating element, alternative or equivalently functioning elements may be used. As is apparent to one of ordinary skill, numerous types of non-helical antenna elements are available that can radiate circularly polarized signals and are thus suitable for a simulcasting an analog and digital signal in an aperture space. While some antenna types do not intrinsically radiate circularly polarized signals, they can be forced to create such a signal when driven by properly configured antenna elements and/or phasing. For example, two sets of linear dipoles being crossed may be properly phased to generate circular polarizations. Therefore, while the above exemplary embodiments illustrate one style of antenna elements, other forms of antennas, either by physical or by signal manipulation, may generate orthogonal signals to achieve reduced cross-coupling.

Moreover, while FIG. 1 illustrates the sequencing of the analog and digital antennas to have the uppermost antenna as an analog antenna 1, it should be appreciated that the sequencing can be reversed to have the uppermost antenna as the digital antenna 2. Similarly, while FIG. 1 illustrates one complete set of antennas on side of the tower 11, multiple sets may be situated about the tower face at varying azimuths or at varying elevations. It should also be appreciated, while FIG. 1 illustrates the respective antenna arrays to be displaced from each other by one wavelength, alternate spacings may be used as point of design preference. Additionally, more or less antenna elements may be used without departing from the spirit and scope of this invention.

Also, while FIG. 1 illustrates the feed assembly 7 as independently feeding the respective antenna systems in a series-type format, parallel or alternate schemes for feeding the antenna systems may be utilized without departing from the spirit and scope of this invention. Variations to the feed system 7 are well known to one of ordinary skill in the art and are not further discussed herein.

Figure 2:
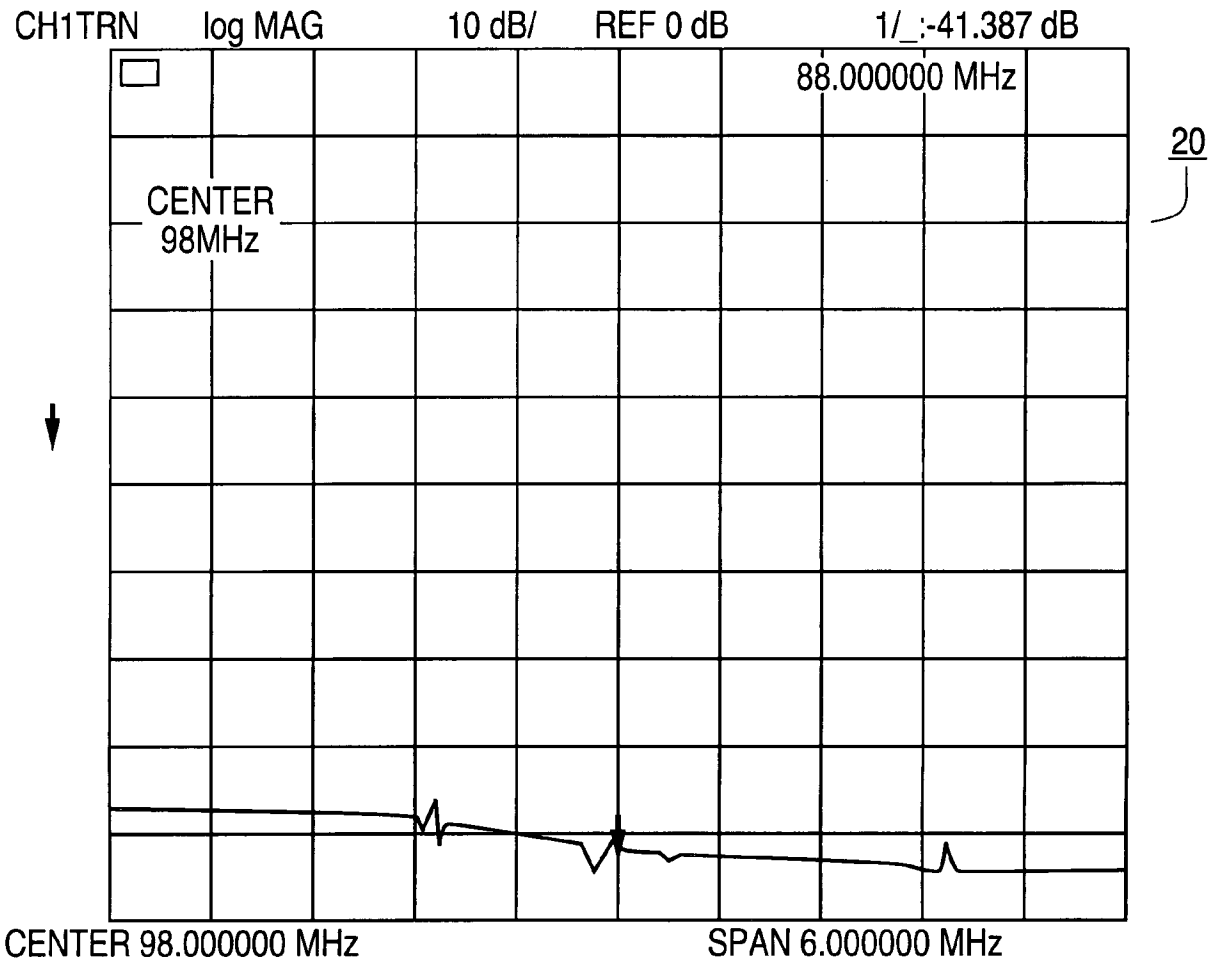
FIG. 2 is a graph illustrating the measured isolation between an array of three analog and digital antennas tested according to the configuration illustrated in FIG. 1.

FIG. 2 is a graph detailing experimentally-measured isolation results between a three element array of digital and analog antennas according to the configuration of FIG. 1. The graph of FIG. 2 was generated by an HP 8753 spectrum analyzer having a center test signal frequency of 98.0 MHz, sweeping from 92.0 MHz to 104.0 MHZ. The x-axis is demarcated in 2 MHz intervals, while the y-axis is demarcated in 2 dB intervals with a baseline reference of 36 dB at the top of the y-axis. The graph shows a measured isolation value of −41.387 dB for an injected test signal between an analog antenna system and a digital antenna system designed in a configuration similar to that of FIG. 1.

The separation distance "X" between the analog system and the digital system was determined to be approximately 12 inches between analog and digital system centers for the operating frequency of interest. For the particular measurement provided in FIG. 2, the distance "X" was settled upon by adjusting the separation of the respective antenna array centers until a maximum isolation value was obtained. This can be achieved by trial and error or based on manipulating the centers to within 1/10–2/10 of the operating wavelength. Of course, it is well known that excessive deviation from the 1/10–2/10 wavelength separation may cause pattern misconfiguration, so care should be exercised when adjusting the distance X.

The separation distance X may be based on distances from the respective antenna array centers or from a reference point, such as for example, the antenna tower 11. Also while the above discussion of the measurement of FIG. 2 entails the adjustment of the separation distance X between the vertical array centers of the analog and digital antennas, it should be appreciated that manipulation of the horizontal separation between antennas may also result in increasing the isolation between the analog and digital systems. Typically, the separation between neighboring analog—digital antennas are in the order of ½ wavelength of the nominal operating frequency, as discussed in the description of the exemplary embodiment of FIG. 1. However, deviations from the ½ wavelength separation may be implemented to take advantage of any increase in isolation that can be achieved.

It should be appreciated that by combining dissimilar antenna arrays and using a separation distance between the arrays, an increase in isolation can be obtained without resorting to the installation of isolators or other signal suppression schemes. It should be noted that depending on the characteristics of the antenna types chosen, separation between the arrays may be nominal, being only one or more inches, or even less, if necessary. Conversely, economic considerations, for example, may result in choosing an antenna type whose isolation is poor, but by use of an increased separation distance between the array centers, sufficient isolation may be obtained between transmitters for the systems to run properly.

It should also be noted that while the exemplary embodiments of this invention are described in the context of FCC compliance for IBOC antenna systems, the aperture and methods described herein may be suitable for non-FCC applications, and thus should not be construed to be limited only to FCC based systems. For example, the exemplary embodiments may be used for solely transmitting digital signals from both the analog and digital arrays of antennas, or vice versus, analog signals may be transmitted by both the analog and digital arrays of antennas. Also, while only three antennas are used in each array of FIG. 1, more or less antennas may be used, depending on system requirements or design preference.

It should be apparent, therefore, that by using the herein described systems and methods, a broadcaster having non-IBOC capabilities and faced with upgrading their analog system to be IBOC compliant may conveniently add digital capable antennas by interleaving them into an existing analog array to their system without adding isolators or removing the existing analog array. Moreover, as demonstrated in FIG. 2, the level of isolation achieved by the exemplary systems and methods herein significantly exceed the requirements mandated by the FCC.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An interleaved broadcast antenna structure, comprising:

a plurality of analog signal transmitting antennas arranged as a substantially collinear first array; and a plurality of digital signal transmitting antennas arranged as a substantially collinear second array, wherein the analog signal transmitting antennas and the digital signal transmitting antennas are of a different antenna type, and an axis of the first array and an axis of the second array are parallel and displaced from each other.

2. The antenna structure of claim 1, further comprising: a feed structure coupled to the antennas of the first and second arrays.

3. The antenna structure of claim 1, wherein the analog signal transmitting antennas of the first array are displaced from each other by approximately one wavelength of an operating broadcast frequency.

4. The antenna structure of claim 1, wherein the digital signal transmitting antennas of the second array are displaced from each other by approximately one wavelength of an operating frequency.

5. The antenna structure of claim 1, wherein the antenna arrays are designed for IBOC broadcast.

6. The antenna structure of claim 1, wherein the displacement is at least 12 inches.

7. The antenna structure of claim 2, wherein the feed structure couples digital and analog signals to the digital and analog signal transmitting antennas, respectively.

8. The antenna structure of claim 1, wherein the analog signal transmitting antennas are quadrapole helixes.

9. The antenna structure of claim 1, wherein the digital signal transmitting antennas are short helixes.

10. The antenna structure of claim 1, wherein the analog signal transmitting antennas and the digital signal transmitting antennas are oppositely polarized.

11. The antenna structure of claim 1, further comprising: an antenna tower.

12. An interleaved broadcast antenna structure, comprising:

a plurality of analog signal radiating means for radiating analog electromagnetic energy arranged as a substantially collinear first array; and a plurality of digital signal radiating means for radiating digitally coded electromagnetic energy, arranged as a substantially collinear second array, wherein the analog radiating means and the digital radiating means are of a different type, and an axis of the first array and an axis of the second array are parallel and displaced from each other.

13. The antenna structure of claim 12, further comprising: feed means for feeding the respective electromagnetic energy to the respective radiating means.

14. The antenna structure of claim 12, wherein the analog signal radiating means of the first array are displaced from each other by approximately one wavelength of an operating broadcast frequency.

15. The antenna structure of claim 12, wherein the digital signal radiating means of the second array are displaced from each other by approximately one wavelength of an operating frequency.

16. The antenna structure of claim 12, wherein the antenna arrays are designed for IBOC broadcast.

17. The antenna structure of claim 12, wherein the displacement is at least 12 inches.

18. The antenna structure of claim 13, wherein the feed means couple digital and analog signals to the digital and analog signal radiating means, respectively.

19. The antenna structure of claim 12, wherein the analog and digital signal radiating means are oppositely polarized.

20. The antenna structure of claim 12, further comprising: support means for supporting both the digital and analog antennas.

21. A method for transmitting digital and analog radio waves, comprising the steps of:

interleaving collinear array of digital signal transmitting antennas into a collinear array of analog signal transmitting antennas;

arranging the arrays of antennas to be parallel and offset from each other;

arranging the antennas of the arrays to be approximately ½ wavelength separated from each other;

feeding a digital signal into the digital signal transmitting antennas;

feeding an analog signal into the analog signal transmitting antennas; and adjusting the offset between the arrays to increase isolation between the analog signal transmitting antennas and the digital signal transmitting antennas.

22. The method according to claim 21, wherein only a digital signal is fed into both the digital signal transmitting antennas and the analog signal transmitting antennas.

23. The method according to claim 21, wherein only an analog signal is fed into both the digital signal transmitting antennas and the analog signal transmitting antennas.

24. A method for assembling a digital and analog array of antennas, comprising the steps of:

interleaving collinear array of digital signal transmitting antennas into a collinear array of analog signal transmitting antennas;

arranging the arrays of antennas to be parallel and offset from each other;

arranging the antennas of the arrays to be approximately ½ wavelength separated from each other; and adjusting the offset between the arrays to increase isolation between the analog signal transmitting antennas and the digital signal transmitting antennas.

* * * * *